United States Patent [19]

Goda et al.

[11] 4,256,025

[45] Mar. 17, 1981

[54] APPARATUS FOR FORMING A HINGED CARTON

[75] Inventors: Boyd D. Goda, Santa Clara; Thomas E. Simpson; Craig J. St. Vincent, both of Redwood City; Peter C. Collura, Los Altos, all of Calif.

[73] Assignee: Kliklok Corporation, Greenwich, Conn.

[21] Appl. No.: 57,116

[22] Filed: Jul. 12, 1979

[51] Int. Cl.[3] ..... B31B 1/46

[52] U.S. Cl. ..... 493/160; 493/171

[58] Field of Search ..... 93/51 R, 51 HW, 51 M, 93/47

[56] References Cited

U.S. PATENT DOCUMENTS

| | | | |
|---|---|---|---|
| 2,189,105 | 2/1940 | Evans et al. | 93/51R |
| 2,684,616 | 7/1954 | Hickin | 93/36 |
| 3,511,138 | 5/1970 | Baker | 93/51 R |
| 3,965,804 | 6/1976 | Elford | 93/51 HW |
| 3,995,539 | 12/1976 | Wallin et al. | 93/51 HW |

*Primary Examiner*—Travis S. McGehee

*Attorney, Agent, or Firm*—Lowe, King, Price & Becker

[57] ABSTRACT

Apparatus for forming a hinged or clamshell type carton from a paperboard blank includes a carton forming die for receiving the paperboard blank, a movable frame for transferring the carton blank from the stack into registration over the die, and a reciprocating plunger mounted above the die for forming the carton. The blank is formed into a finished carton in one simple harmonic motion. The movable frame includes a number of vacuum assisted suction cups for lifting the carton blank from the stack and at least a pair of gathering rollers which cooperate with a pair of pivoting blades mounted adjacent the die to fold and gather the hinge of the carton blank as the blank is positioned and pressed into contact with the die. A pair of inverted "T" retaining bars, disposed on the die adjacent the carton hinge, prebreak glue tabs on the carton and capture and retain the wall panels of the carton when the blank is pressed into registration with the forming die. The blades and "T" bars also accurately locate and position the carton blank with respect to the die. A stacking cage is disposed beneath the carton forming die to receive and retain a plurality of the erected and folded cartons in a vertically stacked, nested arrangement.

14 Claims, 13 Drawing Figures

Fig. 7
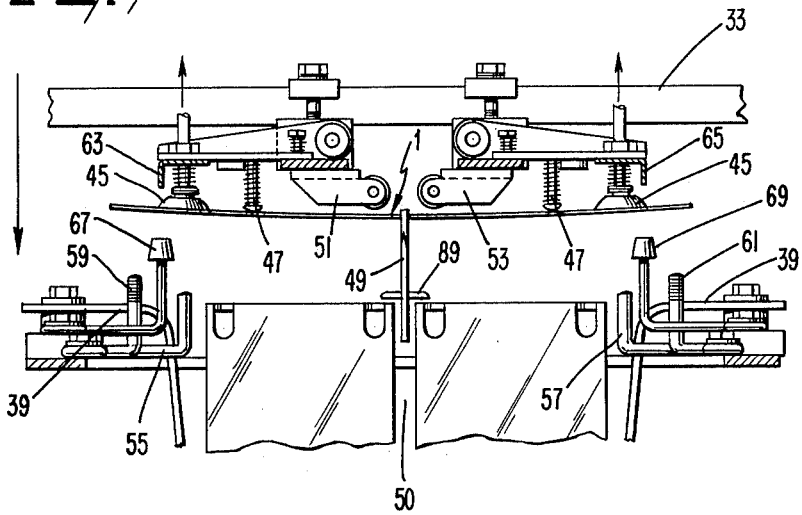
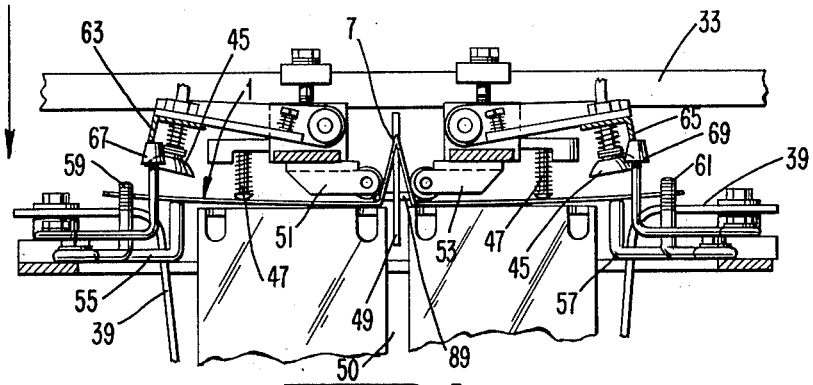
Fig. 8
Fig. 11
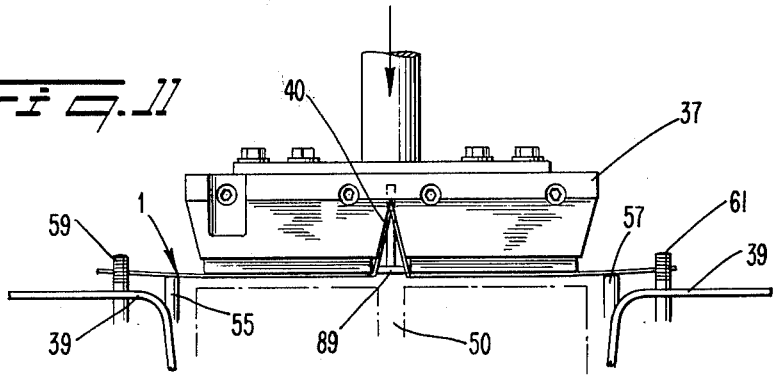

APPARATUS FOR FORMING A HINGED CARTON

TECHNICAL FIELD

The invention relates to carton forming, and more particularly, to apparatus for forming a clam-shell type carton from a coated paperboard blank.

BACKGROUND ART

Many types of cartons formed from folded paperboard or the like have been developed over the years. These cartons fall into two major groups, namely those which use interlocking corners and tabs to secure cartons in their erected position, and those which have an adhesive coating applied to selected portions of the paperboard blank which, erected, are secured in their erected position by the adhesive bond which forms therebetween.

Machinery for folding and erecting both types of paperboard blanks is highly developed. Specially designed machines handle a number of complex operations which must be performed to erect and secure the cartons. Carton blanks which are to be adhesively bonded generally include at least a base panel, wall panels attached to the base panel, and gussets or glue panels formed at the corners of the wall panels. Adhesive is coated on the glue panels or, alternatively, on portions of the wall panels adjacent the glue panels, and the carton walls and glue panels erected and folded into contact with one another and secured together for a time sufficient to allow the adhesive to set.

Prior art machines for performing such carton-forming and gluing operations are exemplified by the patent to Hoyrup, U.S. Pat. No. 3,626,819, issued on Dec. 14, 1971, and assigned to the assignee of the present invention. This patent shows a vertically reciprocating plunger disposed above a carton-forming die. A movable frame or carrier having suction cup means transfers the carton blank from a stack into contacting registration with the upper surface of the carton-forming die. The die includes a number of vertical posts and walls for controllably erecting and folding wall panels of a carton blank disposed over the die when the carton blank is forced therein by the motion of the plunger. Spots or stripes of adhesive are applied to the undersurface of the blank at the die mouth by daubing applicators which rise from pots of liquid adhesive disposed next to the die. One disadvantage of this prior art type of apparatus is that it cannot accommodate the complex and high speed folding and gluing operations which must be performed to form a hinged, clam-shell type carton.

Clam-shell type cartons have two sections, each section including a base panel, wall panels attached to the base panel, and corner panels formed at the corners of the wall panels, with the two sections separated by an articulated hinge, and tab or glue panels formed adjacent the hinges. Such cartons are useful, for example, as containers for fast food items such as hamburgers and the like. The paperboard from which the carton is formed is normally printed with attractive graphics and coated (with a polyethylene coating or the like) to protect the product and prevent absorption of liquid or food juices by the paperboard.

Cartons of the clam-shell type present one particularly difficult forming problem not present when simple trays are being formed. That is, some means must be provided to fold and gather the articulated hinge of the carton blank in the same harmonic motion that is used for the remainder of the folding and gluing steps. Furthermore, the glue panels and tabs adjacent the hinge must be prebroken and carefully controlled so as to lie within the interior of the carton against the preglued areas of the carton walls when the carton is folded and erected by the reciprocating plunger.

Thus, it would be desirable and most efficient to provide apparatus for forming a clam-shell style carton with some means for rapidly and controllably folding and gathering the articulated hinge without adversely affecting the accurate positioning and retention in registration of the blank carton-forming die. The carton-forming apparatus must include means for controllably prebreaking and retaining selected areas of the carton blank prior to full erection of the carton walls. The hinge folding and carton blank prebreaking means should be constructed so as to not interfere in any way with the operation and high speed, harmonic motion of the carton-forming plunger.

OBJECTIVES OF THE INVENTION

It is therefore an object of the invention to provide apparatus for rapidly forming a clam-shell type carton.

It is another object to provide apparatus for rapidly forming a clam-shell type carton having means for accurately locating and securing the carton blank over a carton-forming die.

It is a further object to provide apparatus for rapidly forming a clam-shell type carton having means for forming and gathering the hinge of the carton wherein the carton blank is securely held and accurately registered over the forming die before the plunger erects the carton.

It is yet a further object to provide apparatus for rapidly forming a clam-shell carton including improved means for feeding the carton blank from a stack and preforming the blank during placement into registration with the carton-forming die.

These and other objects are achieved by the present invention wherein there is provided apparatus for rapidly forming a carton from a paperboard blank or the like, the carton having two sections, each section including at least a base panel, wall panels attached to the base panel, and glue panels formed at the corners of the wall panels, with the two sections separated by an articulated hinge, and tab panels formed adjacent the hinge. The apparatus includes a carton-forming die for receiving the paperboard blank, a movable frame having one or more vacuum assisted suction cups mounted thereto for lifting the carton blank from a stack and for transferring the carton blank into registration over the forming die and for pressing the carton blank into contact with the die, and a reciprocating plunger mounted above the die for forcing the carton blank into the die to erect and form the carton. A stacking cage is disposed beneath the carton-forming die for receiving and retaining the erected and formed cartons in a vertically stacked, nested arrangement.

The carton-forming die assembly includes at least one pivotally mounted blade for prebreaking the articulated hinge of the carton blank. The two prebreaking blades of the preferred embodiment also accurately locate the blank when the blank is placed in contacting registration with the upper surface of the die. The prebreaking blades are pivoted out of the die and into a standby position when the reciprocating plunger forces the carton blank into the die. The carton forming die further includes a pair of inverted "T" shaped bars disposed adjacent the hinge of the carton blank for initially erecting and retaining the adjacent panels of the carton blank during hinge gathering and folding.

The movable transfer frame includes at least a pair of rollers which cooperate with the hinge prebreaking blades to controllably fold and gather the articulated hinge of the carton blank when the carton blank is pressed into registration with the forming die.

Other features of the invention include means for automatically releasing the suction cups of the movable frame when the carton blank is placed in registration with the forming die and a longitudinal groove formed on the reciprocating plunger head which is adapted to receive the folded, gathered hinge of the carton blank. Adhesive applicators are attached to the movable carton transfer frame to apply adhesive to selected areas of the carton blank when the blank is pressed into registration with the forming die.

The carton is rapidly set up by the reciprocating plunger which forces the gathered carton through the die to erect the carton walls and fold the corner panels of the carton into contact with the adhesive coated portions of adjacent carton walls. The inverted "T" bars insure that the glue tabs or panels adjacent the gathered hinge are properly aligned to lie within the interior of the carton when it is erected. When the reciprocating plunger reaches its lowest point of harmonic motion with respect to the forming die, the erected carton is ejected from the forming die into a stacking cage which retains the cartons in a stacked arrangement. The cartons are nested one above the other to secure the adhesive coated portions of the wall panels against adjacent corner panels and glue tabs for a time sufficient to allow an adhesive bond to form therebetween. Since the adhesive sets while the erected carton is securely retained in the stacking cage by the pressure applied from the nested cartons, the throughput of the carton-forming apparatus is independent of the adhesive setting time.

BRIEF DESCRIPTION OF THE DRAWING FIGURES

These and other objects and features of the present invention are presented in the following detailed description taken in conjunction with the accompanying drawing figures, wherein:

FIG. 7 is a cross-sectional view of the transfer frame of FIG. 5 taken along lines 7—7 of FIG. 5 and the upper portion of the die assembly;

FIG. 8 is a cross-sectional view of the carton blank transfer frame of FIG. 6 taken along lines 8—8 and the upper portion of the die assembly;

FIG. 11 is similar to FIG. 10 showing the reciprocating plunger as it contacts the carton blank;

Figure 4:
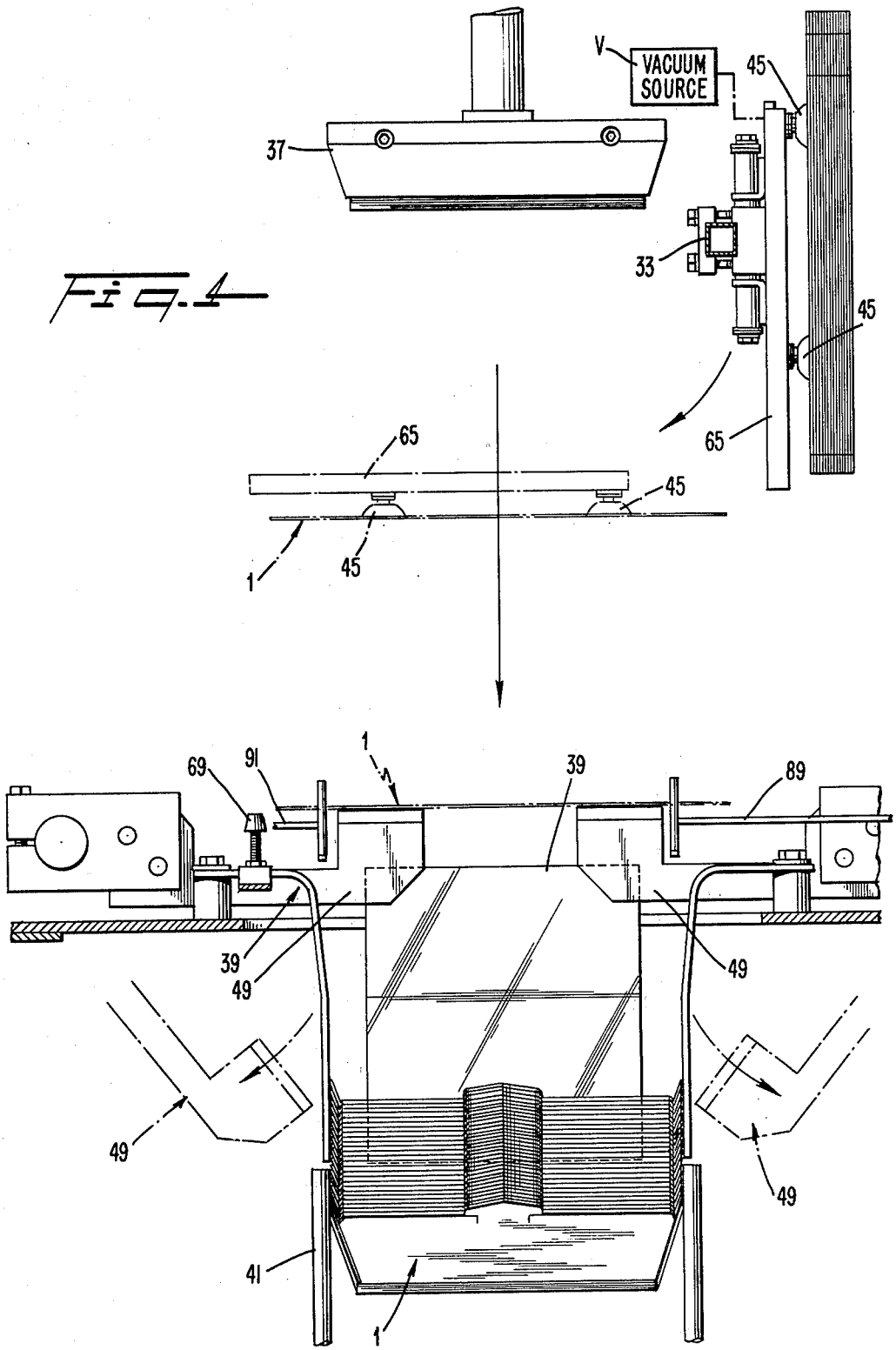
FIG. 4 is a right side cross-sectional view of a preferred apparatus for forming the carton of FIGS. 1 and 3.
Figure 12:
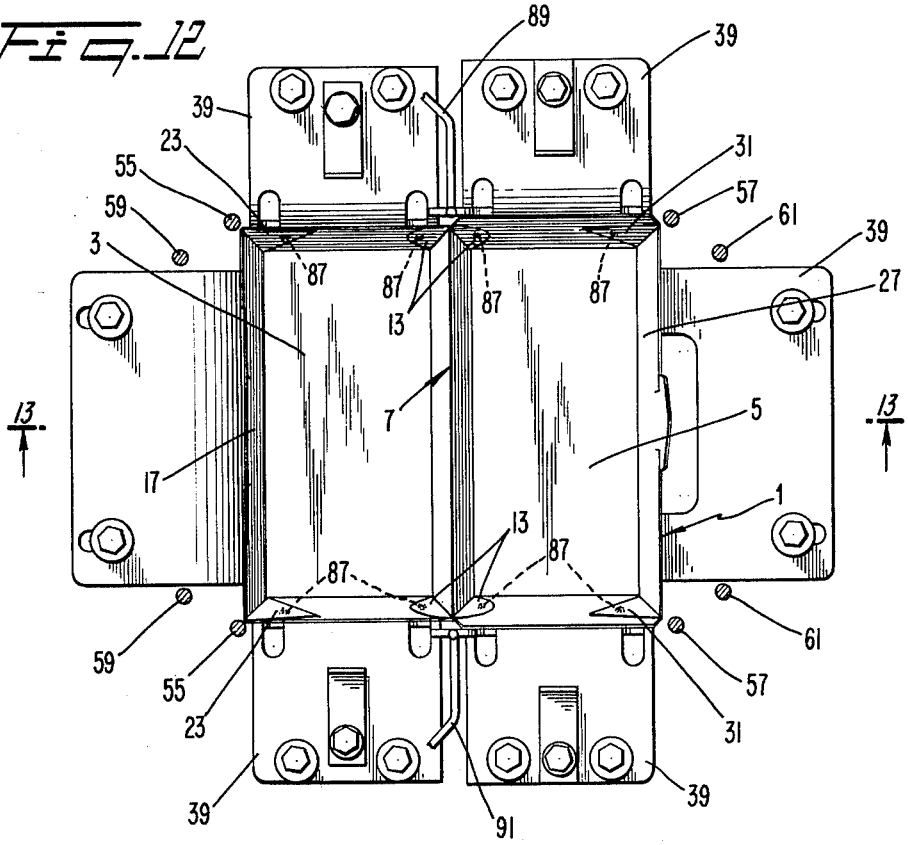
Figure 13:
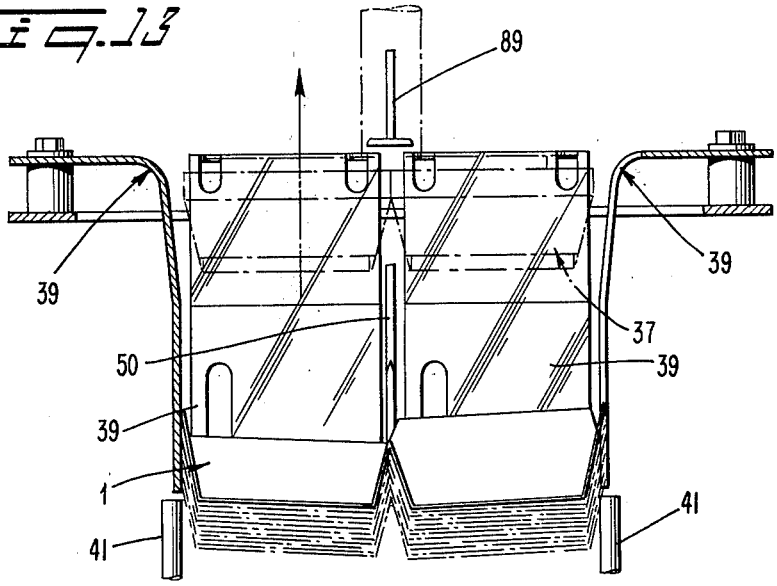

FIG. 12 is a top view of the carton-forming die shown in FIG. 4, illustrating the arrangement of the panels of the carton as the carton is forced into the forming die by the reciprocating plunger, with the plunger removed for clarity; and FIG. 13 is a cross-sectional view of the plunger (dashed lines) and die assembly of FIG. 12 taken along lines 13—13 and illustrating the entry of the stack of cartons into the stacking cage.

DETAILED DESCRIPTION OF THE PREFERRED EMBODIMENT

Figure 1:
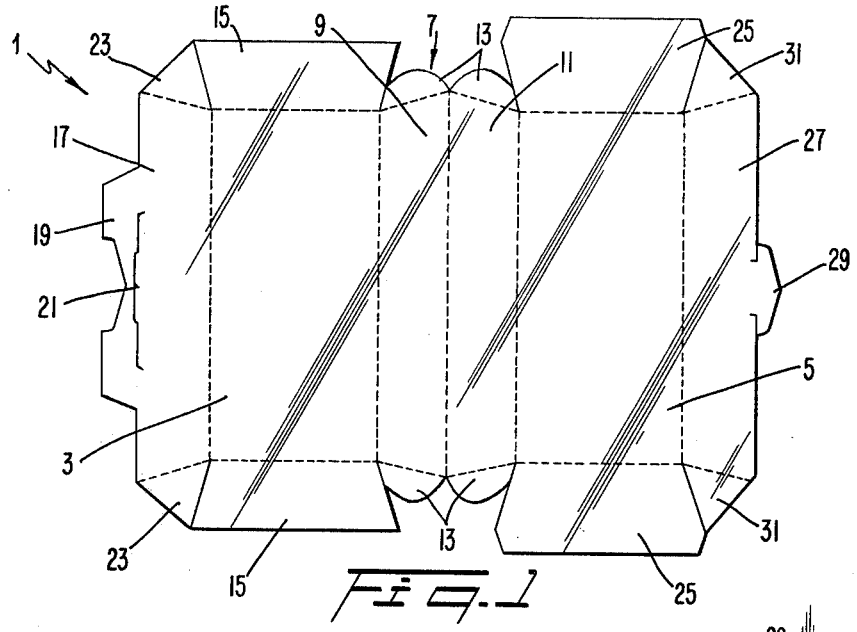
FIG. 1 is a plan view of a preferred type of carton blank for use with the apparatus of the present invention.

A preferred form of a carton blank 1 for use with the apparatus of the present invention is shown in FIG. 1 and includes a left hand base panel 3 and a right hand base panel 5 connected by a "living" or articulated hinge 7. Hinge 7 is formed by a fold between left hand hinge panel 9 and right hand hinge panel 11, which are respectively connected to base panels 3 and 5 and also serve as inner side walls to the two halves of the finished carton. Hinge panels 9 and 11 each include a pair of tabs 13 formed on opposite ends thereof. A pair of end side wall panels 15 are attached to opposite sides of base panel 3. An outer side wall panel 17 is attached to the remaining side of base panel 3. A locking flap 19, including a locking slit 21, is formed on the outer portion of wall panel 17. A pair of folding corner panels 23 are formed between side wall panel 17 and wall panel 15.

Figure 3:
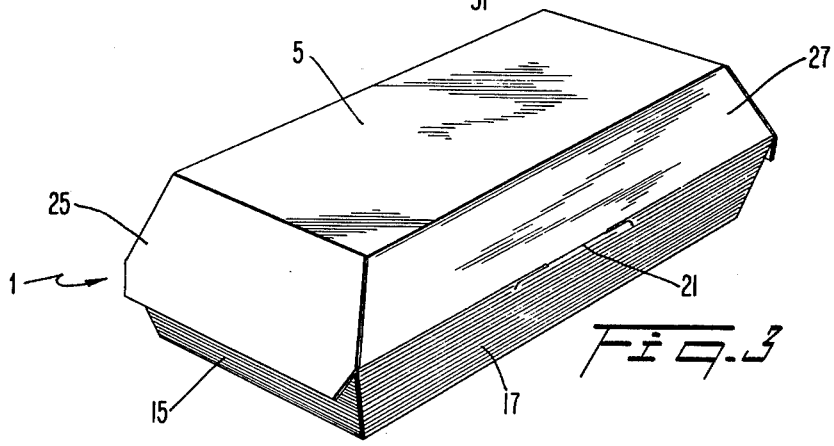
FIG. 3 is a perspective view of the carton blank of FIG. 1 showing it in its final, assembled and closed position.

Similarly, a pair of end wall panels 25 are attached to right hand base panel 5. A right hand outer side panel 27 is attached to the remaining side of right hand base panel 5 and includes a locking tongue 29 which is adapted to fit into locking slit 21 when the carton blank is erected as shown in FIG. 3. A pair of folding corner panels 31 are formed between end panels 25 and outer side panel 27. Corner panels 23 and 31 are separated from their respective adjacent wall panels 15 and 25 by a cut line, shown in solid lines in FIG. 1. The dashed lines in FIG. 1 indicate prescored fold lines of the carton blank.

While the carton 1 is shown as an elongated carton extending in the direction of the hinge, it is clear that the principles of the present invention apply to the other clam-shell carton shapes, such as square or elongated perpendicular to the hinge line.

It will be appreciated that a number of complex folding and gluing operations must be performed in order to form the paperboard blank of FIG. 1 into the completed, clam-shell type carton shown in FIG. 3. The line between hinge panels 9 and 11 of hinge 7 must be properly prebroken and then folded, glue applied to areas of wall panels 15 and 25 adjacent tabs 13 and corner panels 23 and 31, and then the side and end walls of the carton folded and erected into the position shown in FIG. 2.

Contact between tabs 13 and corner panels 23 and 31 and the glued areas on the carton side walls must be maintained for a time sufficient to allow an adhesive bond to form therebetween. It is necessary for the carton-forming apparatus to include relatively simple means for controllably folding and gathering the articulated hinge of the carton blank while it is accurately held in registration with the carton-forming die before the carton walls are fully erected by the reciprocating, harmonic motion of the plunger for maximum speed of the operation.

To this end the carton forming apparatus of the present invention includes a carton blank carrier frame 33 to which is mounted a number of adhesive applicators (not shown) for applying a liquid adhesive under pressure to selected areas of the carton blanks. The adhesive applicators are described in considerable detail in copending U.S. Patent application to Collura et al, Ser. No. 51,854, filed June 25, 1979, and assigned to the assignee of the present invention, the disclosure of which is explicity incorporated by reference herein.

The carton-forming apparatus shown in FIG. 4 also includes a vertically reciprocating plunger 37, a carton-forming head or die assembly 39 disposed directly beneath plunger 37 for receiving a carton blank, such as shown in FIG. 1, and a stacking cage 41 disposed beneath die 39. The cage comprises a number of vertically disposed rails, for receiving and retaining the carton blanks in a stack after erection.

Carton blanks to be folded and erected are sequentially transferred from a stack of carton blanks 43 by means of one or more vacuum assisted suction cups 45 which are connected to the underside of carton blank carrier frame 33. A source of vacuum V is connected to suction cups 45 to pick up one carton blank at a time from stack 43. Carton blank carrier frame 33 is connected to a drive (not shown) for movement about an axis to transfer a single carton blank from stack 43, as shown by solid lines in FIG. 4, into registration directly over forming die assembly 39, as shown by broken lines in FIG. 4. Movable carton blank carrier frame 33 is then moved downwardly toward the upper face of die assembly 39.

As shown clearly in FIG. 7, the carton blank carrier frame 33 includes a number of spring-loaded plungers 47 which bow the blank and prevent the surface of the carton blank from contacting respective left and right hand hinge gathering roller assemblies 51 and 53. Plungers 47 also prevent carton blank 1 from contacting the tips of the adhesive applicators (not shown) until the carrier frame and carton blank are fully registered into contact with the upper surface of forming die 39, as described in the aforementioned application, Ser. No. 51,854 filed June 25, 1979.

As frame 33 approaches the upper surface of forming die assembly 39, one or more hinge folding blades 49 are pivoted into a substantially horizontal position, shown by solid lines in FIG. 4. At this point, blades 49 are aligned with hinge 7 of carton blank 1. Openings 50 (FIG. 5 et seq.) are formed in the side walls of die assembly 39 to allow for the pivoting motion of blades 49. After the hinge 7 is formed, the blades 49 retract out of the way of the plunger 37 (see dotted line position of blades 49 in FIG. 4).

In FIG. 7, carton blank carrier frame 33 is shown disposed over carton-forming die 39. Frame 33 moves further downwardly toward die 39 and carries a carton blank 1, held to frame 33 by suction cups 45, into final registration on the die (FIG. 8). Spring-loaded plungers 47 cause carton blank 1 to be held in a bowed position with respect to frame 33, as earlier explained.

Just prior to the point at which carton blank 1 is fully registered in contact with the surface of the carton-forming die assembly 39, hinge 7 of carton blank 1 contacts the upper edge of hinge prebreaking blades 49, as shown in FIGS. 4 and 7. Blades 49, through contact with hinge 7, also accurately locate the carton blank with respect to forming die 39. The continued downward motion of the transfer frame causes plungers 47 to depress slightly (See FIGS. 7 and 8) and rollers 51 and 53 to contact hinge 7 of the carton on opposite sides of blades 49.

Rollers 51 and 53 cooperate with prebreaking blades 49 to cause hinge 7 of blank 1 to be folded and gathered into an inverted "V" shape, as shown completed in FIG. 8. This constitutes an important feature of the invention in that hinge folding and gathering is accurately and controllably performed when the carton is pressed into registration with the forming die and before the carton is fully erected by the reciprocating plunger. In addition, no separate equipment or complicated auxiliary apparatus is needed to form the hinge of the carton which would interfere with the operating speed of the carton forming plunger.

Figure 9:
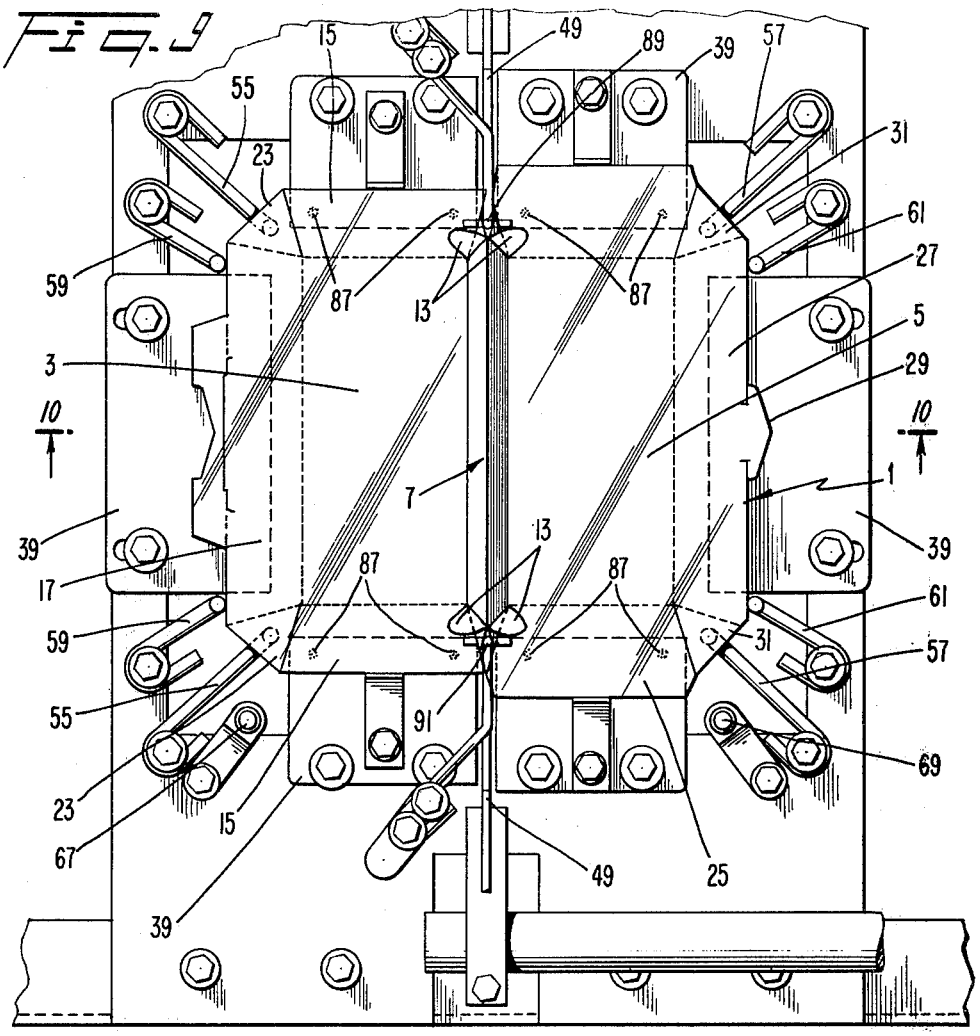
FIG. 9 is a top view of the carton forming die shown in FIG. 4, illustrating the arrangement of the die, corner panel folding posts, "T" bar retainers, and hinge prebreaking and forming blades with respect to the carton blank.
Figure 10:
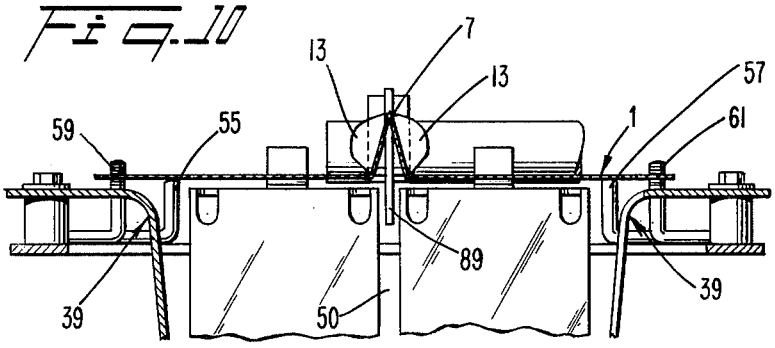
FIG. 10 is a cross-sectional view of the carton-forming die and carton blank of FIG. 9 taken along lines 10—10 of FIG. 9.

When the hinge is formed, the outer edges of side panels 17 and 27 of carton blank 1 are drawn into engagement with respective left and right hand carton registration posts 59 and 61 (see, for example, FIGS. ) 5 and 6). Registration posts 59 and 61 include threaded portions (FIG. 10) formed thereon which engage the outer edges of carton blank end panels 17 and 27 to prevent slippage of the edges off the posts and consequential misalignment of the carton blank after carrier frame 33 is removed from contact therewith. Corner panels 23 and 31 of carton blank 1 are also urged upwardly through contact with respective left and right hand erecting posts 55 and 57 when carton blank 1 is pressed into contact with the upper surface of forming die 39 (FIGS. 9 and 10).

Figure 5:
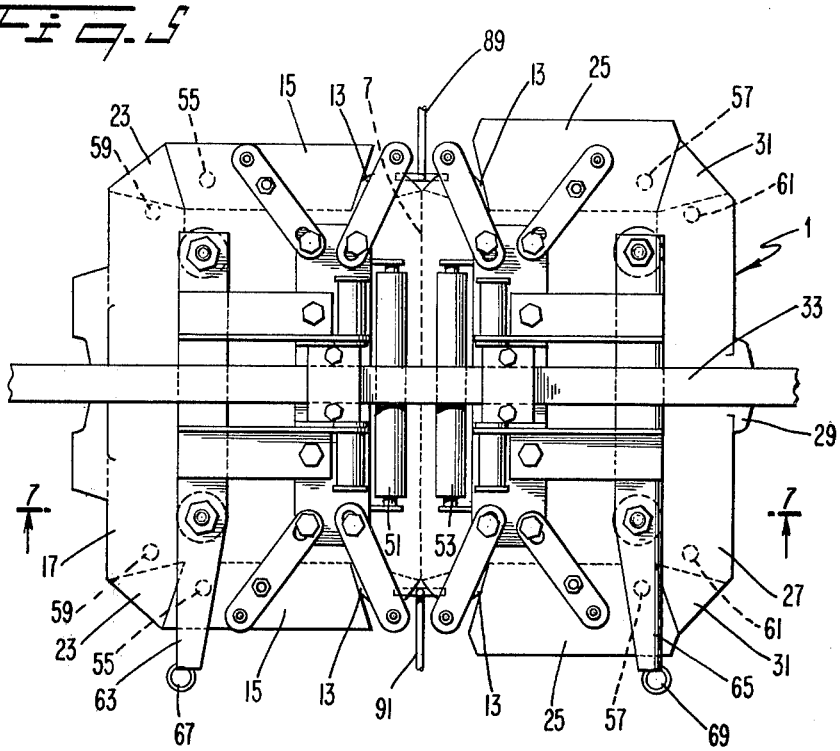
FIG. 5 is a top view of a carton blank transfer frame holding a carton blank in position for initiating the folding of the articulated hinge of the carton blank of FIG. 1.
Figure 6:
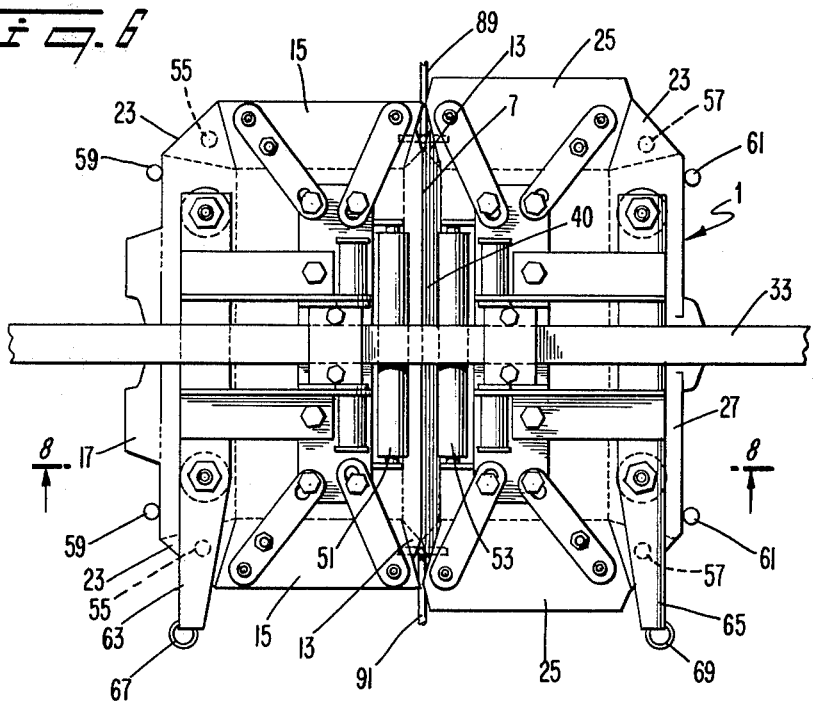
FIG. 6 shows the carton blank transfer frame of FIG. 5 in position for completing the prebreaking and forming of the articulated hinge of the carton blank of FIG. 1.

As carton blank 1 is pressed into contact with die 39, tabs 13 are flipped up by inverted "T" bars 89 and 91 into an upwardly, partially folded position to lie within the interior of carton blank 1 (see, for example, FIGS. 5 and 6). The inverted "T" bars 89 and 91 are physically attached to die 39 on opposite sides of carton hinge 7, as shown in FIG. 9.

The underneath side of the cross piece of the "T" bars 89, 91 engages the top of end panels 15, 25 (FIG. 9) in order to control these panels when the carton is fully registered on the die. The cross piece thus captures and securely retains wall panels 15 and 25 in contact with the upper surface of carton forming die 39. The vertical uprights of "T" bars 89 and 91 also serve to accurately locate and position the ends of hinge 7 with respect to die 39 by alignment in the U-space between the tabs 13. The accurate registration and partial forming of carton blank 1 over die 39, provided by prebreaking blades 49 and "T" bars 89 and 91, constitute another important feature of the invention.

At the same time as the contacting engagement of carton blank 1 with the upper surface of forming die 39 occurs, the ends of respective left and right hand suction cup support arms 63 and 65 contact respective left and right hand bumpers 67 and 69. This action causes the spring-loaded arms to raise and the suction cups 45 to be disengaged from contact with the surface of carton blank 1, as shown in FIG. 8. At this time, the spring-loaded adhesive applicators contact the surface of the carbon blank 1 to apply adhesive to selected areas 87 (FIGS. 2, 9 and 12) of the carton blank, as described in copending application Ser. No. 51,854.

After adhesive has been applied to carton blank 1, the motion of movable frame 33 is reversed, drawing it upwardly away from die 39 and into position (as shown in solid lines in FIG. 4) to pick up and transfer the next carton blank in stack 43.

In FIGS. 10 and 11, carton blank 1 is shown aligned in registration with the upper surface of die 39 subsequent to the application of adhesive to selected areas 87 of the carton blank and removal of carrier frame 33. Side wall panels 15 and 25 of carton blank 1 are secured in a relatively horizontal position over die 39 by the cross-pieces of "T" bars 89 and 91, and tabs 13 (which have been previously prebroken by the "T" bars) are disposed within the interior of the partially erected and gathered carton blank.

Blades 49 are pivoted downwardly into a standby position (shown by dashed lines in FIG. 4). Reciprocating plunger 37 is then actuated to move downwardly into contact with the upper surface of carbon blank 1 disposed over die 39, as shown in FIG. 11. Plunger 37 includes a longitudinal groove 40 (shown in FIG. 11) to accommodate the gathered hinge 7 of carton 1. The downward motion of plunger 37 forces carton blank 1 into the mouth of die 39 with corner panels 23 and 31 being fully folded and erected through contact with posts 55 and 57. As carton blank 1 is further urged into die 39, side and end panels 15, 25, 17 and 27 are erected. When carton 1 is fully erected, corner panels 23 and 31 and hinge tabs 13 are disposed adjacent to and in contact with previously applied spots of adhesive 87 as shown in FIG. 12 (with plunger 37 removed for clarity).

Figure 2:
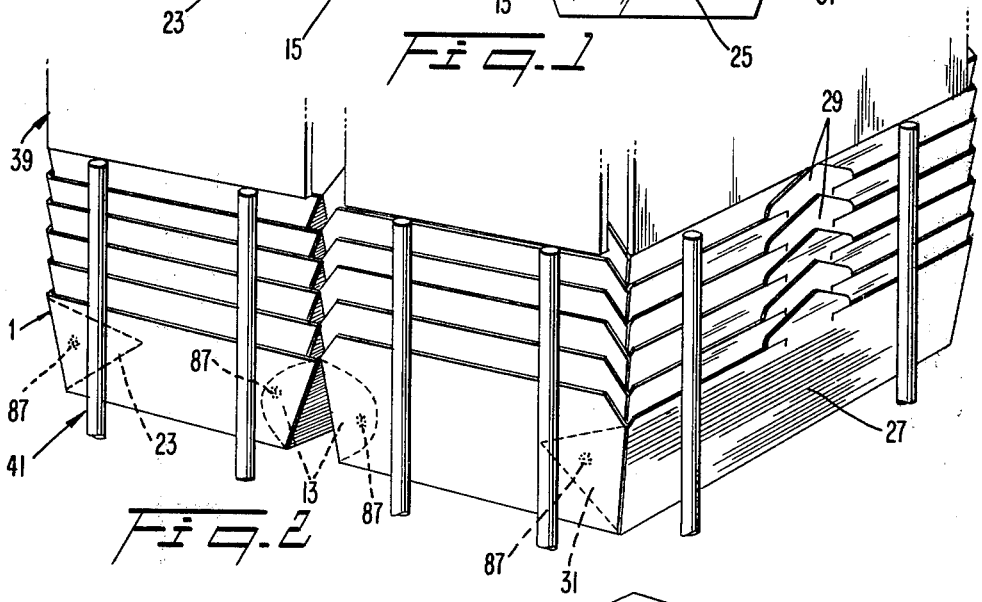
FIG. 2 is a perspective view of a carton stacking cage showing the folded and erected carton blanks of FIG. 1 in their nested position.

When plunger 37 reaches its lowest point of reciprocating harmonic motion with respect to die 39, the erected carton is ejected into a stack that enters a stacking cage 41, as shown in FIG. 13. Stacking cage 41 comprises a number of vertically disposed guide rails. Stacking cage 41 receives and retains the erected cartons in a nested fashion, one within the other. The exterior of a nested carton is in intimate contact with the interior of the next lower carton, as shown in FIG. 2. This arrangement causes corner panels 23, 31 and tabs 13 to be securely held against glued areas 87 of wall panels 15 and 25 while the adhesive sets. An important advantage of this arrangement is that the "throughput" or number of cartons is maximized since the speed is independent of the adhesive setting time. Cartons 1 are readily removed one by one from the bottom of stacking cage 41 when required by an associated filling mechanism, or in bulk nested together for shipment to satellite use centers, such as fast food outlets.

It can thus be seen that the present invention has many advantages over other types of apparatus for forming a clam-shell type carton. Hinge folding is performed rapidly and accurately when a carton blank, carried on the movable carton blank transfer frame, is pressed into contact with the forming die. The hinge prebreaking blades and unique "T" retaining bars serve to accurately locate and position the carton blank over the forming die during hinge folding. The carton folding apparatus is designed for maximum speed and versatility for forming a clam-shell type carton.

While the carton forming apparatus of the present invention has been described in considerable detail, it is understood that various changes and modifications may occur to persons of ordinary skill in the art without departing from the spirit and scope of the appended claims.

We claim:

1. Apparatus for forming a carton from a paperboard blank or the like, the carton having two sections, each section including at least a base panel, wall panels attached to the base panel, and corner panels formed at the corners of the wall panels, the two sections separated by an articulated hinge, and tab panels formed adjacent the hinge comprising:

a carton-forming die for receiving said paperboard blank, said die including:

means for prebreaking said articulated hinge of said carton blank, said hinge prebreaking means accurately locating said carton blank when said blank is placed in contacting registration with said die; and means for erecting and retaining selected panels of said carton during subsequent folding;

means for sequentially feeding a carton blank from a stack into contacting registration with said carton-forming die, said feeding means including:

means, cooperating with said prebreaking means of said die, for folding and gathering said articulated hinge when said carton blank is placed in contacting registration with said die;

a reciprocating plunger for forcing said gathered carton blank into said die to fold and erect said wall panels of said carton; and means, disposed beneath said carton-forming die, for receiving and retaining a plurality of said erected and folded cartons in a vertically stacked arrangement, said cartons being nested within one another.

2. The apparatus of claim 1 wherein said carton blank feeding means comprises:

a movable frame;

at least one vacuum assisted suction cup mounted to said frame for lifting a carton blank from said stack;

means for moving said frame to transfer said carton blank carried by said suction cup from said stack into registration over said carton-forming die and for pressing said carton blank into contact with said die; and said folding and gathering means includes at least a pair of rollers mounted to said frame, said rollers cooperating with said prebreaking means of said die to fold and gather said articulated hinge of said carton blank when said carton blank is pressed into contact with said die.

3. The apparatus of claim 2 wherein said carton blank feeding means further includes means for releasing said vacuum assisted suction cup when said carton blank is pressed into contact with said die.

4. The apparatus of claim 1 wherein said carton blank receiving and retaining means comprises a stacking cage having a plurality of vertically disposed, spaced-apart guide rails.

5. The apparatus of claim 1 wherein said carton hinge prebreaking means comprises:

at least one forming blade pivotally attached to said die, said blade being pivoted into a substantially horizontal position with respect to an upper surface of said die when said carton blank, carried by said feeding means, is placed in contacting registration with said die, said forming blade cooperating with said folding and gathering means of said carton blank feeding means to fold and form said articulated carton hinge when said carton blank is pressed into contact with said die.

6. The apparatus of claim 5 including a pair of said forming blades, said blades pivoting from said horizontal position to a standby position with respect to said die when said reciprocating plunger forces said carton blank into said die.

7. The apparatus of claim 1 wherein said plunger includes a longitudinal groove formed along a lower portion thereof which is adapted to receive and control said folded, gathered hinge.

8. The apparatus of claim 1 wherein said means for erecting and retaining selected panels of said carton comprises:

a pair of inverted "T" retaining bars disposed on opposite sides of said die and adjacent said articulated hinge, whereby the center post and cross-bar of each of said "T" bars initially prebreaks a pair of said tab panels formed adjacent said articulated hinge, and the cross-bar of said "T" bar captures and retains adjacent wall panels of said carton blank when said carton blank is pressed into contact with said die and said hinge is folded and gathered.

9. Apparatus for forming a clam-shell type carton from a paperboard blank or the like, the carton having two sections, each section including at least a base panel, wall panels attached to the base panel, and corner panels formed at the corners of the wall panels, the two sections separated by an articulated hinge, and tab panels formed adjacent the hinge, comprising:

a carton-forming die for receiving said paperboard blank, said die including:

at least one hinge folding blade pivotally attached to said die, said blade accurately locating said carton blank when said blank is placed in contacting registration with said die; and a pair of inverted "T" retaining bars disposed on opposite sides of said die adjacent said articulated hinge;

means for sequentially feeding a carton blank from a stack into contacting registration with said carton forming die, said feeding means including:

a movable frame;

at least one vacuum assisted suction cup mounted to said frame for lifting a carton blank from a stack;

means for moving said frame to transfer said carton blank carried by said suction cup from said stack into registration over said die and for pressing said blank into contact with said die; and at least a pair of rollers mounted to said frame, said rollers cooperating with said folding blade of said die to fold and gather said articulated hinge of said carton blank when said carton blank is pressed into contact with said die, whereby the center post and cross-bar of each of said "T" bars initially prebreaks a pair of said tab panels formed adjacent said articulated hinge and the cross-bar of said "T" bar captures and retains adjacent wall panels of said carton blank when said carton blank is pressed into contact with said die;

a reciprocating plunger for forcing said gathered carton blank into said die to fold and erect said wall panels of said carton; and a stacking cage disposed beneath said carton-forming die, for receiving and retaining a plurality of said erected and folded cartons in a vertically stacked arrangement, said cartons being nested within one another.

10. The apparatus of claim 9 wherein said carton blank feeding means further includes means for releasing said vacuum assisted suction cup when said carton blank is pressed into contact with said die .

11. The apparatus of claim 9 wherein said stacking cage includes a plurality of vertically disposed, spaced apart guide rails.

12. The apparatus of claim 9 wherein said plunger includes a longitudinal groove formed along a lower portion thereof which is adapted to receive and control said folded, gathered hinge.

13. The apparatus of claim 9 including a pair of said forming blades, said blades pivoting from a substantially horizontal position with respect to an upper surface of said die when said carton blank, carried by said feeding means, is placed in contact with said die, to a standby position with respect to said die when said reciprocating plunger forces said carton blank into said die.

14. The apparatus of claim 13 wherein said blades are aligned with said articulated hinge of said carton blank when in said horizontal position, and wherein said carton forming die includes openings to accommodate the pivotal movement of said blades.

* * * * *